United States Patent [19]

Talafous

[11] 4,121,443

[45] Oct. 24, 1978

[54] METHOD OF AND APPARATUS FOR ROLLING LONG WORK PIECES

[75] Inventor: Jiri Talafous, Brno, Czechoslovakia

[73] Assignee: Vyzkumny ustav tvarecich stroju a technologie tvareni, Brno, Czechoslovakia

[21] Appl. No.: 843,884

[22] Filed: Oct. 20, 1977

[30] Foreign Application Priority Data

Oct. 20, 1976 [CS] Czechoslovakia ..... 6749-76

[51] Int. Cl.[2] ..... B21H 1/18

[52] U.S. Cl. ..... 72/108; 72/102

[58] Field of Search ..... 72/108, 107, 102, 118

[56] References Cited

U.S. PATENT DOCUMENTS

| | | | |
|---|---|---|---|
| 3,208,257 | 9/1965 | Holub | 72/108 |
| 3,827,269 | 8/1974 | Hoagland et al. | 72/102 |

*Primary Examiner*—Lowell A. Larson

[57] ABSTRACT

Method of and apparatus for elongating a work piece axially while reducing it in diameter by subjecting it to rolling in a rolling mill having opposed similar rolls of the multiple wedge type rotating in the same direction through at least two revolutions. In a first revolution of the rolls the axially central part of the work piece is reduced in diameter by first sets of oppositely directed rolling members on the opposed rolls, and in the second revolution of the rolls the axially central part of the preliminarily rolled work piece is further reduced in diameter and axially elongated by second sets of oppositely directed rolling members on the opposed rolls.

4 Claims, 4 Drawing Figures

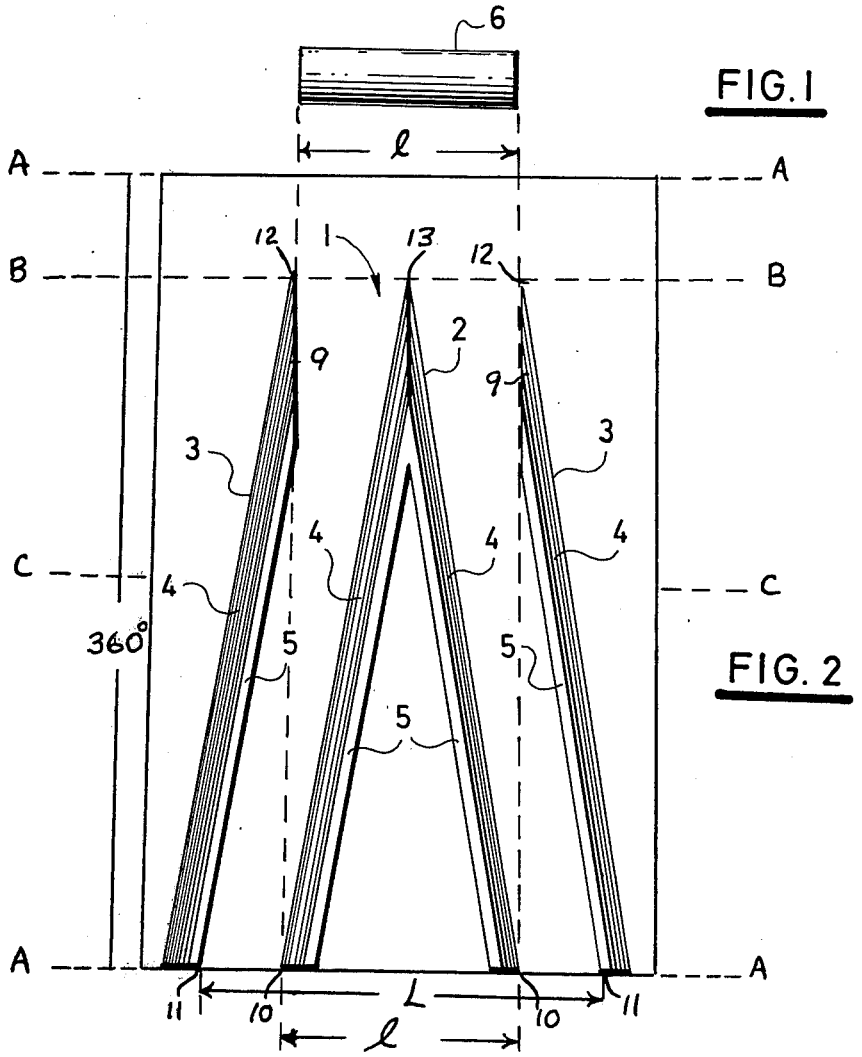
FIG. 1
FIG. 2
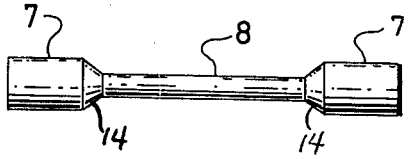
FIG. 3
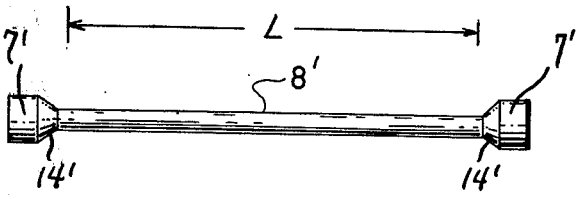
FIG. 4

METHOD OF AND APPARATUS FOR ROLLING LONG WORK PIECES

This invention relates to a method of and apparatus for the production of long work pieces by cross wedge rolling from billets between opposed rolls of a roll pass having wedge shaped rolling formations on the rolls, the rolls being drivingly rotated in the same direction.

Cross wedge rolling is employed to produce parts which, for example, are of dumbbell shape in which the greatest length of their rolled portions is limited by the length and apex angle of opposed wedge formations on rolls rotating in the same direction. The length of the wedge formations on the roll is limited because of the spacing between their starting or entrance ends and their exit ends which is necessary for permitting the billets to be worked between the rolls, for removing the rolled parts, and for the amount of rotation of the rolls which is necessary to bring them to a stop after a rolling operation.

If a very long rolled part is to be produced having a great length of the central rolled or reduced portion it is necessary to increase the entering angle between the opposed rolling formations on each roll. This, however, is possible only to a certain extent, and results in a lower quality of the rolled parts and a considerably higher load imposed upon the rolling formations by the forces necessary to deform the work piece.

These drawbacks of prior cross wedge rolling of very long parts are eliminated by the present invention, wherein the billet to be rolled is reduced in diameter at least in certain parts thereof and is elongated axially during at least two revolutions of the opposed rolls of a roll pass, the rolls of which bear similar multiple wedge shaped rolling formations.

In accordance with a preferred embodiment of the invention the production of very long parts is carried out by rolls bearing wedge shaped rolling formations which comprise an axially internal wedge portion extending peripherally of the rolls and at least two axially external wedge portions which are axially spaced beyond the respective sides of the internal wedge formation.

The method and apparatus of the invention also have the advantage that the length of the rolled parts or the length of the portion thereof being reduced and axially elongated can be varied without changing the rolls because, according to a preferred embodiment of the invention, the external wedge portions are axially adjustable relative to the internal wedge portions of the respective rolls.

The invention will be more readily understood upon reference to the accompanying drawings and the description thereof. In the drawings:

FIG. 1 is a side elevation of a billet which is to be worked by a multiple wedge roll according to the invention;

FIG. 2 is a developed view of a multiple wedge roll in accordance with the invention;

FIG. 3 is a view in side elevation of a rolled part or piece produced by the axially internal wedge portions of opposed rolls of a roll stand in accordance with the invention, and FIG. 4 is a side elevation of a rolled part in its final shape, such part having been formed by the axially external wedge portions of opposed rolls having rolling formations thereon in accordance with FIG. 2.

A round metal billet 6, adapted to be deformed by a roll stand having opposed rolls with rolling formations thereon is shown in FIG. 2.

FIG. 2 depicts in developed form the peripheral surface of a roll rotating about an axis C—C in the direction of the arrow. In a preferred embodiment of the apparatus, two identical rolls 1 are mounted in a two-high rolling stand in vertically spaced relationship, the spacing between the rolls being determined by a conventional rolling mill screwdown. The two rolls 1 are driven in the same direction of rotation from a gear box disposed beyond one end of the rolls, the gear box having upper and lower driven output shafts, the output shafts being connected to the respective rolls through interposed shafts and universal joints which permit the spacing between the rolls 1 to be varied by the screwdown. The billet is introduced between the opposed rolls 1 when the portions of the opposed rolls in advance of the entering ends of the wedge formations thereon are in confronting relationships. In FIG. 2 such zone in advance of the wedge formations on roll 1 lies between the lines A—A and B—B. The billet to be worked or being worked is retained in position between opposed rolls 1 by opposed guide members which extend inwardly between the opposed rolls 1 from opposite sides of the rolling zone between the rolls to guidingly engage at least the axially opposite ends of the billet or work piece being rolled thereby to maintain the longitudinal axis of the work piece in the plane connecting the axes of the opposed rolls 1.

The inner wedge formation 2 of the roll 1 as well as the outer members 5 constituting a second wedge formation are provided with inclined work piece reducing surfaces 4 which terminate in a direction outwardly of the paper in flat smoothing surfaces 5. The entering ends 12 of the outer segments 3 and the entering end 13 of the axially central wedge formation 2 lie on a common line B—B. The axially inner surfaces 9 of the formations 3 lie in respective planes transverse to the axis C—C of the roll 1, surfaces 9 being spaced from each other by a distance 1. The axially outer trailing ends 10 of the members 4 of the inner wedge formation are also spaced from each other axially of the roll by the distance 1. The axially inner trailing edges 11 of the formations 3 are spaced from each other by a distance L. The length of the billet 6 is equal to and preferably at least slightly smaller than the distance L, in order that the billet may enter freely between the surfaces 9 during the first revolution of the rolls 1.

It will be apparent from what has been said above that in the working zone proper of the roll stand the reducing of surface 4 of the formations 2 and 3 on the opposed rolls 1 travel linearly in opposite directions in engagement with the work piece being shaped. After the billet has been introduced into the apparatus and the rolls 1 are started in rotation the axially central portion of the billet 6 is reduced in diameter and axially elongated as shown at 8 in FIG. 3. During such first rotation of the rolls 1 the end portions 7 of the work piece remain unreduced or substantially unreduced in diameter, since the periphery of the billet 6 at its ends only lightly engage or need not engage at all the peripheral surfaces of the rolls 1 which lie between the wedge formations 2 and 3 thereon.

During the second revolution of the rolls 1 the axially central portion 8 of the once-deformed work piece passes the wedge formation 2 without further deformation. However, the axially end portions 7 of such work piece are now engaged by the oppositely inclined formations 3 which engage portions 7 to reduce the axially inner ends of portions 7 to the same diameter as part 8 in FIG. 3, the finished work piece, shown in FIG. 4, having an axial central portion 8′ of uniform diameter and end portions 7′ of reduced axial length as compared to the work piece in FIG. 3 but still having their original diameter.

It will be apparent from FIGS. 3 and 4 that the surfaces 4 of the wedge formation 2 have the same angle of inclination with respect to the paper in FIG. 2 as the geometrical elements of the frusto-conical portions 14 in FIG. 3 which line the paper of that figure. It will also be apparent that the surfaces 4 of the axially outer wedge shaped formations 3 have an inclination with respect to the paper of FIG. 2 which is the same as that of the geometrical elements of the frustoconical portions 14′ of the member in FIG. 4 lying in the paper of that figure.

The wedge formation 2 may be formed integral with the body of the roll 1 or it may be made separately therefrom and suitably secured to the exterior thereof as by bolts extending outwardly through the body 1, which may be made in the form of a thick walled cylinder, into the members making up the formation 2. As mentioned above, the elements 3 of the axially outer wedge formation may be made adjustable with respect to the body of the roll 1. Such adjustment may be in a direction axially of the body of the roll 1, the adjustment being effected by the provision of slots through the thick walled cylindrical body of the roll 1 the slots being directed axially of the roll, bolts being passed from within the body of the roll outwardly into tapped holes in the element 3. By loosening such bolts and sliding the elements 3 a desired distance apart and then tightening the bolts the elements 3 may be suitably positioned to produce finished work pieces such as that shown in FIG. 4 which are either longer or shorter than the work piece thereshown.

The method and apparatus of the invention are preferably practiced in the shaping of metal billets, which are usually heated to a working temperature. However, the method and apparatus of the invention may also be employed in the shaping of billets of other materials which can be suitably deformed to produce shaped products such as shown in FIG. 4 from starting work pieces the axially central portions of which it is desired to reduce in diameter and to increase in length.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. A method for producing long parts by the cross wedge rolling of billets of selected length, comprising disposing two similar rolls in spaced confronting relationship with their axes parallel, each of the rolls having wedge formations on its periphery, the wedge formations on the respective rolls confronting each other and being spaced from each other, rotating the rolls in the same direction and at the same angular speed, synchronizing the rotation of the two rolls so that the leading ends of the wedge formations on the respective rolls engage the billet at the same time, in one rolling operation rotating the rolls through at least two revolutions, in the first revolution reducing the axially central portion of the billet in diameter and elongating it axially while leaving the end portions of the billet substantially unreduced in diameter and substantially unelongated by engaging the axially central portion of the billet by first wedge formations on the rolls, and in a second, following revolution of the rolls, reducing in diameter and elongating axially the axially inner portions of said end portions of the billet which remained after the first revolution of the rolls by engaging them with a second set of axially outer wedge formations which are oppositely inclined with respect to each other on the rolls.

2. An apparatus for producing long parts by cross wedge rolling of billets of selected length, comprising a pair of similar rolls, means for rotatably mounting the rolls in confronting spaced relationship with their axes parallel, means drivingly connecting the rolls and rotating them in synchronism in the same direction at the same angular speed, a first, axially inner wedge shaped set of billet deforming formations upon each of the respective rolls, said first wedge shaped formations having their apices pointing in the direction of rotation of the respective rolls, the first wedge shaped formations on the rolls being so disposed that their apices first engage the billet being worked upon at the same time, the first wedge shaped formations of the two rolls reducing the axially central portion of the billet in diameter and elongating it during the first revolution of the rolls, a second, axially outer set of wedge formations on each of the rolls composed of inclined forming members extending generally parallel to and axially outwardly of the axially outer edges of the respective first wedge shaped formations, the second sets of wedge shaped formations during the second revolution of the rolls engaging the end portions of the billet which remain unreduced in diameter and unelongated after the first revolution of the rolls and reducing them in diameter and elongating them during the second revolution of the rolls.

3. Apparatus as claimed in claim 2, wherein each of the second sets of wedge shaped formations is composed of separate spaced elongated members, and comprising means for adjusting said elongated members axially of the respective rolls.

4. Apparatus as claimed in claim 2, wherein the spacing axially of the roll of the leading ends of the elongated members forming the respective second set of wedge shaped formations is no greater than the axial spacing between the axially outer edges of the trailing ends of the first, wedge shaped set of billet deforming formations on the same respective roll.

* * * * *